US009198251B2

(12) United States Patent
Ter Weeme et al.

(10) Patent No.: US 9,198,251 B2
(45) Date of Patent: Nov. 24, 2015

(54) TUNABLE CORRELATED COLOR TEMPERATURE LED-BASED WHITE LIGHT SOURCE WITH MIXING CHAMBER AND REMOTE PHOSPHOR EXIT WINDOW

(71) Applicant: KONINKLIJKE PHILIPS N.V., Eindhoven (NL)

(72) Inventors: Berend Jan Willem Ter Weeme, Eindhoven (NL); Martinus Petrus Joseph Peeters, Weert (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/413,015

(22) PCT Filed: Jul. 17, 2013

(86) PCT No.: PCT/IB2013/055891

§ 371 (c)(1),
(2) Date: Jan. 6, 2015

(87) PCT Pub. No.: WO2014/013462

PCT Pub. Date: Jan. 23, 2014

(65) Prior Publication Data

US 2015/0173151 A1 Jun. 18, 2015

Related U.S. Application Data

(60) Provisional application No. 61/672,805, filed on Jul. 18, 2012.

(51) Int. Cl.

| | |
|---|---|
| ***H05B 33/08*** | (2006.01) |
| ***F21K 99/00*** | (2010.01) |
| *F21Y 101/02* | (2006.01) |

(52) U.S. Cl.
CPC ..... *H05B 33/0863* (2013.01); *F21K 9/56* (2013.01); *H05B 33/0896* (2013.01); *F21Y 2101/02* (2013.01)

(58) Field of Classification Search
None
See application file for complete search history.

(56) References Cited

U.S. PATENT DOCUMENTS

| | | | |
|---|---|---|---|
| 7,723,744 | B2 | 5/2010 | Gillies et al. |
| 8,067,254 | B2 | 11/2011 | Camras et al. |

(Continued)

FOREIGN PATENT DOCUMENTS

| | | | |
|---|---|---|---|
| DE | 202011000007 | U1 | 4/2012 |
| WO | 2008071206 | A1 | 6/2008 |

OTHER PUBLICATIONS

Lei Chen et al; "Light Converting Inorganic Phosphors for White Light-Emitting Diodes", Materials, vol. 3, No. 3, March 22, 2010, pp. 2172-2195, XP0550033041.

*Primary Examiner* — Crystal L Hammond
(74) *Attorney, Agent, or Firm* — Yuliya Mathis

(57) ABSTRACT

A light source (600) includes: a plurality of LEDs (610), including one or more first LEDs (612) configured to emit first light having a first color, one or more second LEDs (614) configured to emit second light having a second color, and one or more third LEDs (616) configured to emit third light having a third color; a mixing device (620) configured to mix the first light, the second light, and the third light into a mixed light, wherein the mixing device includes an exit window (640) configured such that the mixed light is emitted from the mixing device through the exit window; and a light-conversion material (6300 provided at the exit window, wherein the light-conversion material is configured to convert the first light from the first color to a lime color.

17 Claims, 6 Drawing Sheets

(56) References Cited

U.S. PATENT DOCUMENTS

| | | | | |
|---|---|---|---|---|
| 8,104,908 | B2 | 1/2012 | Harbers et al. | |
| 2002/0154379 | A1* | 10/2002 | Tonar et al. | 359/267 |
| 2004/0218387 | A1* | 11/2004 | Gerlach | 362/231 |
| 2008/0062706 | A1 | 3/2008 | Feldmeier | |
| 2008/0231214 | A1 | 9/2008 | Kim et al. | |
| 2010/0102729 | A1* | 4/2010 | Katzir et al. | 315/113 |
| 2010/0188022 | A1* | 7/2010 | Gerlach et al. | 315/312 |
| 2011/0127930 | A1* | 6/2011 | Bennette | 315/312 |
| 2011/0133654 | A1 | 6/2011 | McKenzie et al. | |
| 2011/0148327 | A1 | 6/2011 | Van De Ven et al. | |
| 2011/0175117 | A1 | 7/2011 | Jagt et al. | |
| 2012/0091923 | A1* | 4/2012 | Kastner-Jung et al. | 315/360 |
| 2012/0119670 | A1* | 5/2012 | Vinkenvleugel et al. | 315/291 |
| 2013/0070440 | A1* | 3/2013 | Levermore et al. | 362/84 |

* cited by examiner

TUNABLE CORRELATED COLOR TEMPERATURE LED-BASED WHITE LIGHT SOURCE WITH MIXING CHAMBER AND REMOTE PHOSPHOR EXIT WINDOW

CROSS-REFERENCE TO PRIOR APPLICATIONS

This application is the U.S. National Phase application under 35 U.S.C. §371 of International Application No. PCT/IB13/055891, filed on Jul. 17, 2013, which claims the benefit of U.S. Provisional Patent Application No. 61/672,805, filed on Jul. 18, 2012. These applications are hereby incorporated by reference herein.

TECHNICAL FIELD

The present invention is directed generally to a light emitting diode (LED)-based light source, and in particular, an LED-based light source which can provide a tunable correlated color temperature.

BACKGROUND

Illumination devices based on semiconductor light sources, such as light-emitting diodes (LEDs), offer a viable alternative to traditional fluorescent, HID, and incandescent lamps. Functional advantages and benefits of LEDs include high energy conversion and optical efficiency, longer expected lifetime, lower operating costs, and many others.

There is a need for a remote controlled tunable LED-based white light source, wherein the correlated color temperature of the light source can be adjusted over a wide rage to meet a provide a desired characteristic which may be changed as a function of time, or from installation to installation or application to application. Often such tunable white light sources are built with several LEDs which emit primary colors, and one or more phosphor converted LED(s), and the light from all of these LEDs is combined to produce the desired white light. Red, Green, Blue and White devices are often used. In other White light sources, Red and Green LEDs are used together with a Cool-White LED and an Amber or phosphor-converted Amber (PCA) LED. Here, a remote controlled tunable LED-based white light source includes an LED-based white light source included in a lighting device meant for a wall dimmer.

As used herein, when referring to a device or LED as being a Red device or a Red LED, it is meant that the device or LED emits Red light. Similarly, a Blue device or Blue LED is one which emits Blue light, a Green device or Green LED is one which emits Green light, a White device or White LED is one which emits White light, etc. Furthermore, when referring to "a phosphor-converted LED", it is meant an LED element having a phosphor material layer coated thereon for converting or changing the color of the light emitted by the LED element to a different color.

However, these known remote controlled tunable LED-based White light sources typically have a considerably lower efficiency than white light sources with a fixed correlated color temperature, so they require more energy and more LED elements to produce the same light output level. In particular, the use of Green LEDs in remote controlled tunable LED-based white light sources can result in a light source which exhibits a reduced efficiency compared to a "regular" white source. In general Green LEDs are less efficient than Blue LEDS, but Green LEDs can still supply quite a bit of light. However, since the Green light emitted by a Green LED is quite a distance in the color triangle away from the target (White) color, one needs to mix quite a bit Red light together with the Green light to get the desired White color. Furthermore, Red LEDs become inefficient at elevated temperatures. Reduced efficiency also means that more LEDs are required to achieve a desired light output level than would be required in a more efficient light source, thereby significantly increasing the cost and size of the light source.

Thus, it would be desirable to provide a remote controlled tunable correlated color temperature LED-based White light source which can operate efficiently and be tuned over a relatively wide color temperature range.

SUMMARY

The present disclosure is directed to inventive methods and apparatus for providing a remote controlled tunable correlated color temperature LED-based White light source.

Generally, in one aspect, the invention relates to a lighting unit that includes an LED-based light source, which, in turn, includes: a plurality of light-emitting diodes (LEDs), including at least one White LED, at least one Blue LED and at least one Red LED; a mixing device configured to mix light output by the plurality of LEDs, wherein the mixing device includes an exit window configured for the mixed light to be emitted from the mixing device; and a light-conversion material provided at the exit window, wherein the light-conversion material is configured to convert light emitted from the at least one Blue LED to a White color, and further to convert light emitted from the at least one White LED to a Lime color.

In one embodiment, the light-conversion material is configured to convert light from the at least one Blue LED to be cool White light.

The light-conversion material may include or consist essentially of a LuAG phosphor.

In one embodiment, the Lime color has a peak output at a wavelength of between 550-580 nm.

In some embodiments, the Lime color lies within an area of the CIE 1931 color space chromaticity diagram bounded by the coordinates: 0.456, 0.524; 0.354, 0.605; 0.308, 0.494; and 0.413, 0.451. According to one optional feature of this embodiment, the Lime color lies within an area of the CIE 1931 color space chromaticity diagram bounded by the coordinates: 0.357, 0.490; 0.395, 0.474; 0.425, 0.528; and 0.393, 0.564.

The light emitted from the at least one White LED may be a neutral White light, a warm White light, or an off-White light In some embodiments, wherein the light-conversion material converts the light emitted from the at least one White LED to a Lime color with an efficiency of between 40-55%.

In some embodiments, the lighting unit further includes a lighting controller configured to adjust a correlated color temperature of the LED-based light source by adjusting relative current levels provided to the at least one White LED, the at least one Blue LED, and the at least one Red LED.

In some embodiments, the lighting unit further includes a user interface connected to the lighting controller, configured to provide one or more signals to the lighting controller for selecting the correlated color temperature of the LED-based light source In other embodiments, the lighting unit further includes a lighting controller configured to adjust a correlated color temperature of the LED-based light source by adjusting relative current levels provided to the at least one White LED, the at least one Blue LED, and the at least one Red LED.

Generally, in another aspect, the invention relates to a light source that includes: a plurality of LEDs, including one or more first LEDs configured to emit first light having a first color, one or more second LEDs configured to emit second light having a second color, and one or more third LEDs configured to emit third light having a third color; a mixing device configured to mix the first light, the second light, and the third light into a mixed light, wherein the mixing device includes an exit window configured such that the mixed light is emitted from the mixing device through the exit window; and a light-conversion material provided at the exit window, wherein the light-conversion material is configured to convert the first light from the first color to a Lime color.

In one embodiment, the first color is White, the second color is Blue, and the third color is Red or Red-Orange.

In one embodiment, the first light is a Blue light with a primary wavelength less than 460 nm, wherein the second light is a Blue or Cyan light with a primary wavelength greater than 460 nm, and wherein a conversion efficiency of the light-conversion material is greater at the primary wavelength of the first light than at the primary wavelength of the second light.

In one embodiment, the Lime color lies within an area of the CIE 1931 color space chromaticity diagram bounded by the coordinates: 0.456, 0.524; 0.354, 0.605; 0.308, 0.494; and 0.413, 0.451.

Generally, in yet a still further aspect, the invention relates to a light source that includes: a plurality of LEDs, including at least a first group of one or more first LEDs configured to emit first light having a first color, at least a second group of one or more second LEDs configured to emit second light having a second color, and at least a third group of one or more third LEDs configured to emit third light having a third color; a cover disposed in a light emission path of the first group of LEDs; a light-conversion material provided at the cover, wherein the light-conversion material is configured to convert the first light from the first color to a Lime color; and a mixing device having an exit window, wherein the mixing device is configured to receive the converted first light output from the cover, to receive the second light, and to receive the third light, and to mix the first light, second light, and third light and to output a mixed light from the exit window.

In one embodiment, the first color is Blue, the second color is blue or a cool White, and the third color is Red or Red-Orange.

The light-conversion material may include or consist essentially of a LuAG phosphor.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, Red LEDs, Blue LEDs, Green LEDs, Yellow LEDs, Amber LEDs, Orange LEDs, and White LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially White light (e.g., a White LED) may include a number of dies which respectively emit different spectra of electroluminescence that, in combination, mix to form essentially White light. In another implementation, a White light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of White LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based light sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both White and non-White light.

The term "color temperature" generally is used herein in connection with White light, although this usage is not intended to limit the scope of this term. Color temperature essentially refers to a particular color content or shade (e.g., reddish, bluish) of White light. The color temperature of a given radiation sample conventionally is characterized according to the temperature in degrees Kelvin (K) of a black body radiator that radiates essentially the same color point as the radiation sample in question. Black body radiator color temperatures generally fall within a range of from approximately 700 degrees K (typically considered the first visible to the human eye) to over 10,000 degrees K; White light generally is perceived at color temperatures above 1500-2000 degrees K.

Lower color temperatures generally indicate White light having a more significant Red component or a "warmer feel," while higher color temperatures generally indicate White light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under White light having a color temperature of approximately 3,000 degree K has a relatively reddish tone, whereas the same color image viewed under White light having a color temperature of approximately 10,000 degrees K has a relatively bluish tone.

The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enable communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

As discussed above, known remote controlled tunable LED-based White light sources typically have a considerably lower efficiency than White light sources with a fixed correlated color temperature, so they require more energy to produce the same light output level. And in particular, the use of Green LEDs in remote controlled tunable LED-based White light sources can result in a light source which exhibits a reduced efficiency compared to a "regular" white source.

Therefore, Applicants have recognized and appreciated that it would be beneficial to provide a remote controlled tunable correlated color temperature LED-based White light source which can operate efficiently and output light whose color can be tuned or adjusted over a relatively wide range of color temperatures.

In view of the foregoing, various embodiments and implementations of the present invention are directed to a remote controlled tunable correlated color temperature LED-based White light source which mixes three selected color light components including a Lime color component, and a lighting unit that includes such a remote controlled tunable correlated color temperature LED-based White light source.

Figure 1:
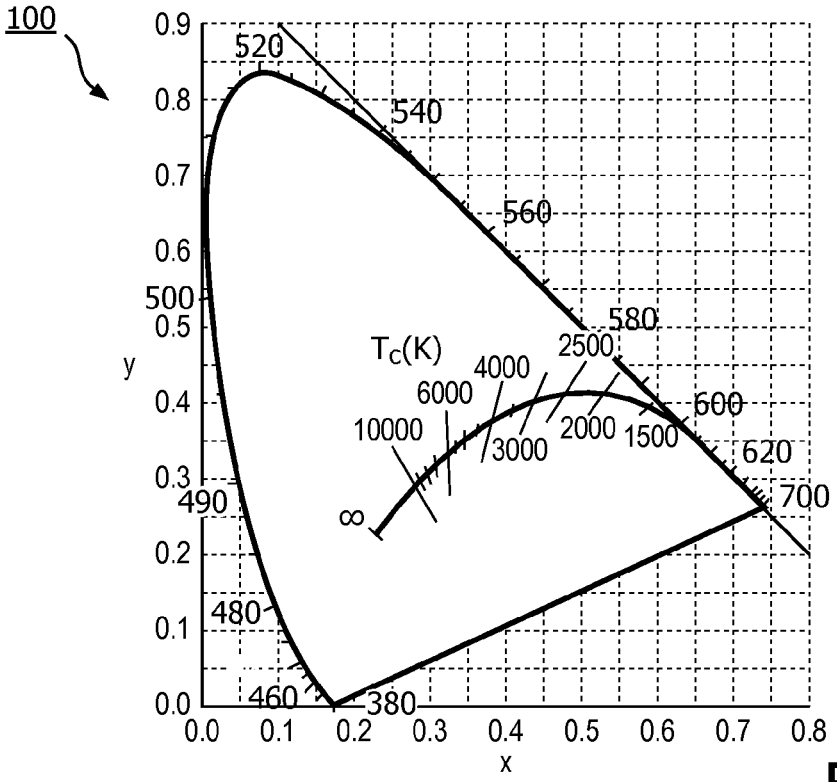
FIG. 1 illustrates the CIE 1931 color space chromaticity diagram, also showing the chromaticities of black-body light sources of various temperatures (Planckian locus), and lines of constant correlated color temperature.

FIG. 1 illustrates the CIE 1931 color space chromaticity diagram, also showing the chromaticities of black-body light sources of various temperatures (Planckian locus), and lines of constant correlated color temperature. In general, light having a higher color temperature is considered to be Cool White light, light having a lower color temperature is considered to be Warm White light, and light having a color temperature between Cool White light and Warm White light may be considered to be Neutral White light. Off-White light may be considered to be light having a color temperature in the vicinity of Neutral White light but located some distance above the black body line shown in FIG. 1.

For the purposes of this patent application, Warm White light is defined as being light whose color lies within an area bounded by the vertices whose coordinates are shown in Table 1 below, Neutral White light as s being light whose color lies within an area bounded by the vertices whose coordinates are shown in Table 2 below, and Off-White light as being light whose color lies within an area bounded by the vertices whose coordinates are shown in Table 3 below.

TABLE 1

| CIE1931 (xyY) | | CIE Luv | |
|---|---|---|---|
| x | y | u' | v' |
| 0.390 | 0.375 | 0.232 | 0.502 |
| 0.400 | 0.410 | 0.225 | 0.518 |
| 0.480 | 0.430 | 0.267 | 0.538 |
| 0.470 | 0.400 | 0.274 | 0.525 |

TABLE 2

| CIE1931 (xyY) | | CIE Luv | |
|---|---|---|---|
| x | y | u' | v' |
| 0.350 | 0.350 | 0.215 | 0.485 |
| 0.350 | 0.380 | 0.204 | 0.499 |
| 0.400 | 0.410 | 0.225 | 0.518 |
| 0.390 | 0.375 | 0.232 | 0.502 |

TABLE 3

| CIE1931 (xyY) | | CIE Luv | |
|---|---|---|---|
| x | y | u' | v' |
| 0.436 | 0.441 | 0.235 | 0.535 |
| 0.335 | 0.483 | 0.165 | 0.535 |
| 0.297 | 0.399 | 0.165 | 0.499 |
| 0.352 | 0.380 | 0.205 | 0.499 |

In general, it is desired to provide a White light source with a wide tunable correlated color temperature range, for example tunable over a range spanning 2000 K to 6500 K, or even wider.

Applicants have discovered that a White light source with a wide tunable correlated color temperature range may be achieved by mixing together light having three particular color components in varying ratios. More specifically, Applicants have discovered that such a White light source may be achieved by employing Blue light, Red-Orange light and Lime light.

Figure 2:
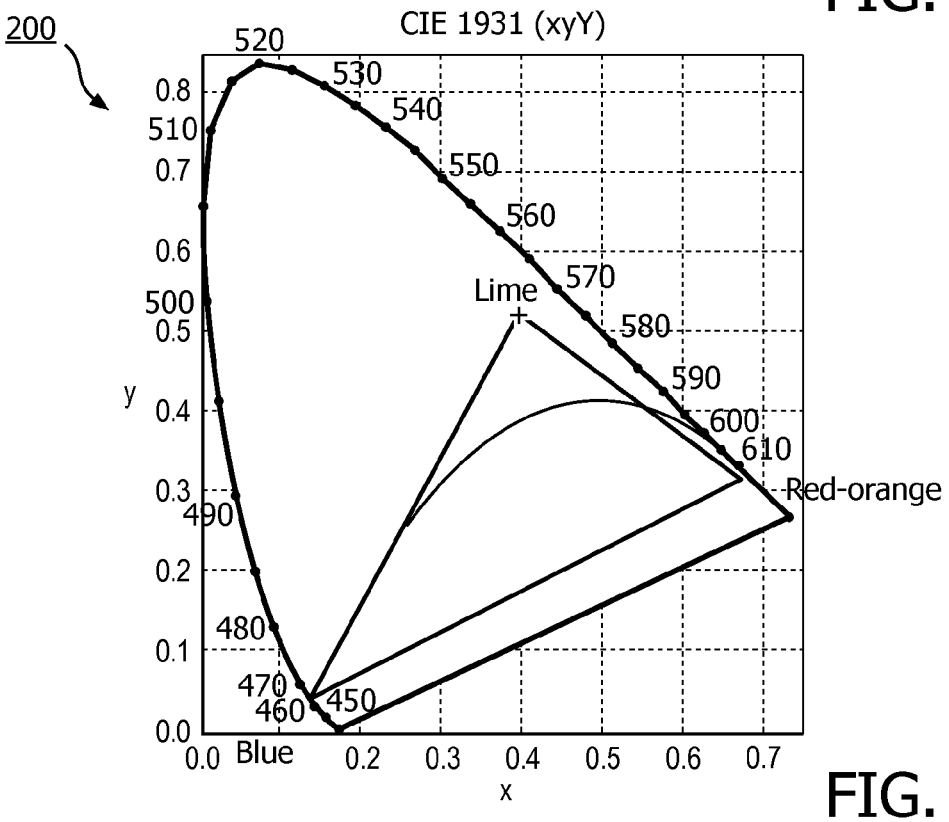
FIG. 2 illustrates in CIE 1391 color space color components which may be employed by a tunable correlated color temperature LED-based White light source to provide White light having a tunable color temperature.

FIG. 2 illustrates in CIE 1391 color space three color components which may be employed by a tunable correlated color temperature LED-based White light source to provide White light having a tunable color temperature. In particular, FIG. 1 illustrates a tunable range of White light which may be produced by employing a Blue color component, a Red-Orange color component, and a Lime color component, in varying ratios. The combination of Blue, Lime, and Red-Orange (or Red) color components may yield a tunable White light source with a relatively high efficiency, a good color rendering index (CRI) and a wide color triangle (and therefore a wide color temperature tuning range).

As can be seen from FIG. 2, the vertex on the color triangle from the Blue color component can be moved inward somewhat without too much loss in the tunable color temperature range. Therefore, an alternative arrangement which may be employed in some embodiments is a combination of Cool-White, Lime, and Red-Orange (or Red) color components.

In general, the Lime color component may be considered to be light having a peak output at a wavelength in a range of 550 nm-580 nm, and particularly light which is highly saturated at or near 560 nm.

Beneficially, the Lime color light component is light whose color lies within an area bounded by the vertices whose coordinates are shown in Table 4 below.

TABLE 4

| CIE1931 (xyY) | | CIE Luv | |
|---|---|---|---|
| x | y | u' | v' |
| 0.456 | 0.524 | 0.218 | 0.563 |
| 0.354 | 0.605 | 0.148 | 0.570 |
| 0.308 | 0.494 | 0.148 | 0.535 |
| 0.413 | 0.451 | 0.218 | 0.535 |

Even more beneficially, the Lime color light component is light whose color lies within an area bounded by the vertices whose coordinates are shown in Table 4 below.

TABLE 5

| CIE1931 (xyY) | | CIE Luv | |
|---|---|---|---|
| x | y | u' | v' |
| 0.357 | 0.490 | 0.175 | 0.540 |
| 0.395 | 0.474 | 0.200 | 0.540 |
| 0.425 | 0.528 | 0.200 | 0.560 |
| 0.393 | 0.564 | 0.175 | 0.565 |

Figure 3:
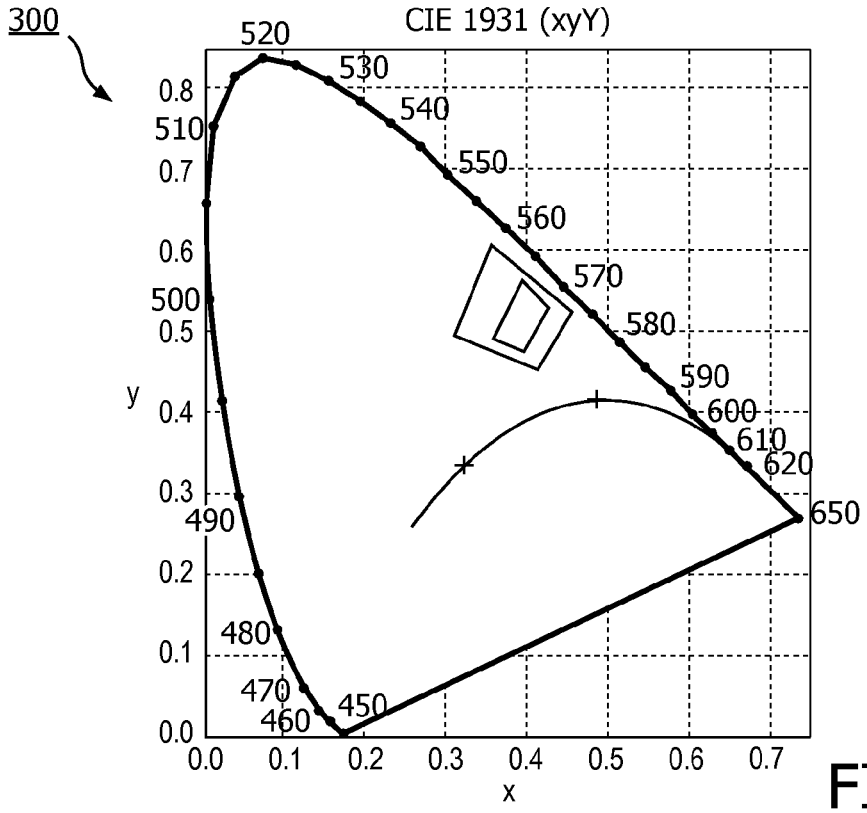
FIG. 3 illustrates in CIE 1391 color space a range of colors which may be employed as a Lime color component of a tunable correlated color temperature LED-based White light source.

FIG. 3 illustrates in CIE 1391 color space a range of colors which may be employed as a Lime color component of a tunable correlated color temperature LED-based White light source. In particular, FIG. 3 plots on the CIE 1391 color space the coordinates if the areas defined by Table 4 and Table 5 above.

At this time, however, Lime LEDs are not widely and readily available. Moreover, it is unknown if Lime LEDS will become widely and readily available in the near future. Furthermore, even if and when Lime LEDS become widely and readily available, it is possible that they might be specialty components which command a price premium. It would be desirable to use low cost and widely available components to produce the Lime color component.

Accordingly, Applicants have determined that it would be desirable to provide a Lime color component in an LED-based White light source without the need for a Lime LED.

Figure 4:
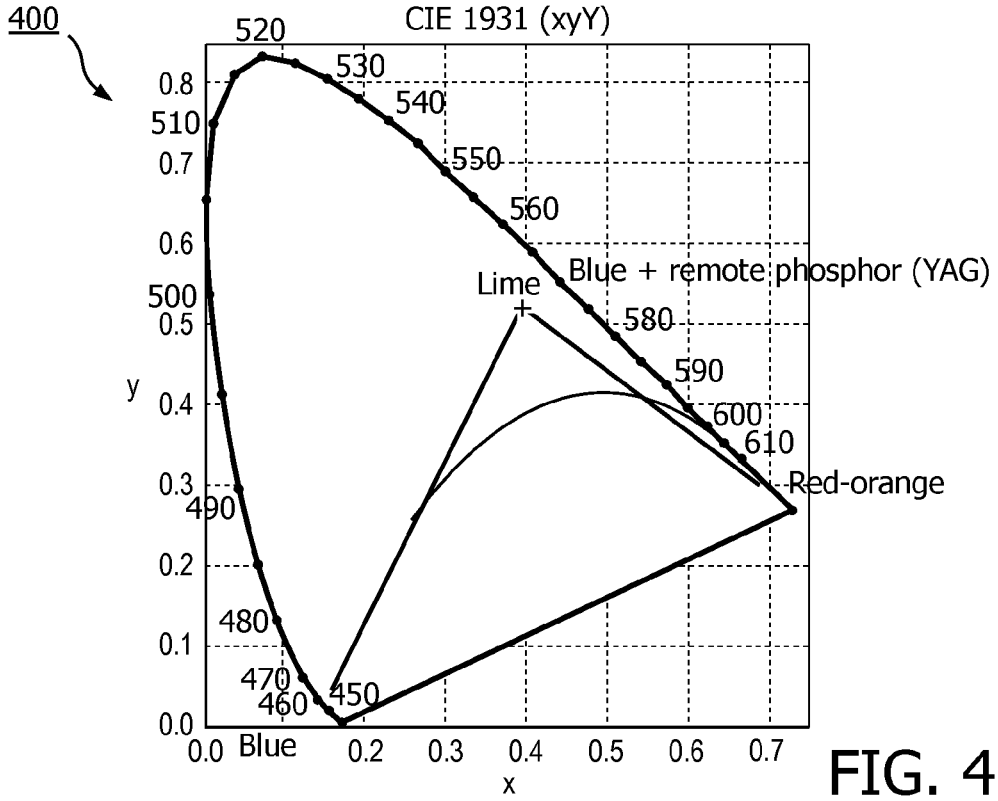
FIG. 4 illustrates in CIE 1391 color space color components of an LED-based Blue light source which employs color conversion towards Lime color.

One option for producing an LED-based White light source is to combine light from one or more Blue LEDs and one or more Red LEDs in a mixing device, such as a mixing cavity or chamber, which includes a color conversion element which converts the Blue light to Lime. FIG. 4 illustrates in CIE 1391 color space color components of an LED-based White light source which employs color conversion. In particular, FIG. 4 illustrates an arrangement which includes a Red or Red-Orange color component, which may be produced by one or more Red or Red-Orange LEDS, and a Blue color component which may be produced by one or more Blue LEDs. Here and in the claims, it is understood that a Blue LED is defined to include LEDs commonly referred to commercially as "Blue" and having dominant wavelengths between 460 and 490 nm, and LEDs commonly referred to commercially as "Royal Blue" or "Deep Blue" and having a peak wavelength in the range 440 nm-460 nm.

As illustrated in FIG. 4, the Blue color component is converted by a light conversion material to a Lime color component. The Lime color component may be produced by placing a remote phosphor over the Blue LEDs, for example by coating a mixing chamber in which Red (or Red-Orange) light from the Red (or Red-Orange) LEDs and the Blue light from the Blue LEDs is mixed. The remote phosphor converts the Blue light to Lime light. However, in this arrangement color temperature tunability is lost.

Figure 5:
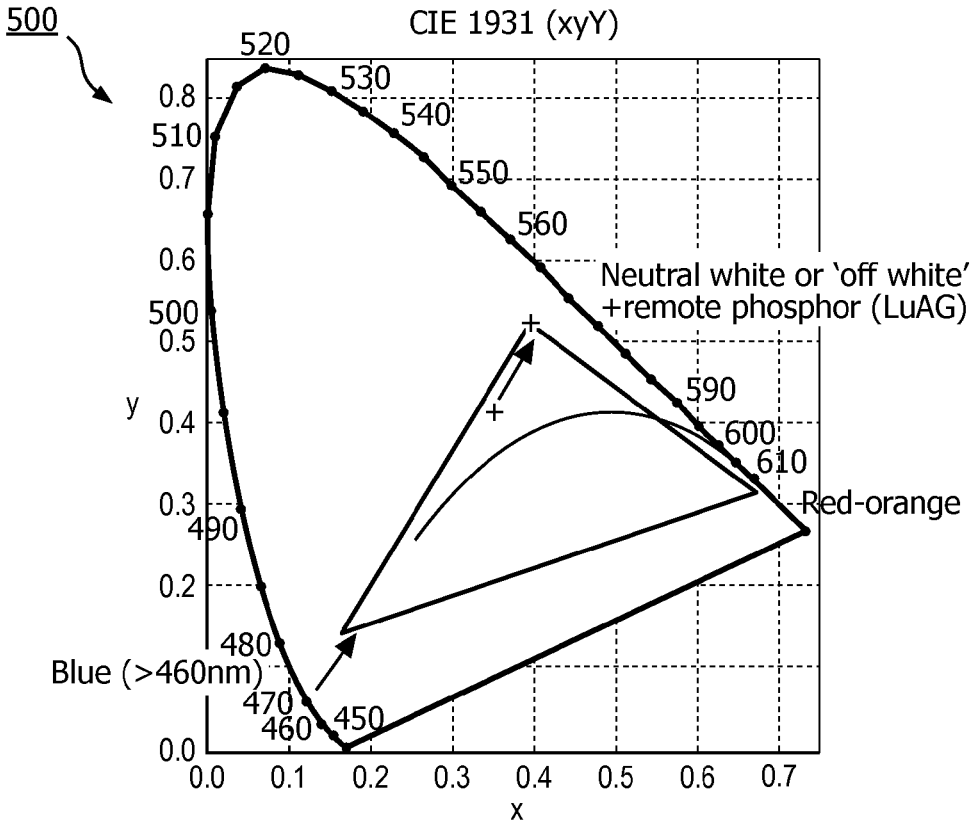
FIG. 5 illustrates in CIE 1391 color space color components which may be employed by one embodiment of a tunable correlated color temperature LED-based White light source to provide White light having a tunable color temperature.

FIG. 5 illustrates in CIE 1391 color space color components which may be employed by one embodiment of a tunable correlated color temperature LED-based White light source to provide White light having a tunable color temperature over a desired range. In particular, FIG. 5 illustrates how a White color component may be converted to Lime, and a Blue color component may be converted to a less saturated Blue or a relatively Cool White or Cool Off-White color to thereby produce, in combination with a Red or Red-Orange color component, White light having a color temperature which is tunable over a desired range. For example, the White color component, the Blue color component and the Red or Red-Orange color component may all be passed through a translucent remote phosphor with a moderate conversion efficiency so as to perform this color conversion of the White and Blue color components. The remote phosphor may perform very little if any conversion of the Red (or Red-Orange) light. Beneficially, this arrangement may provide White light having a tunable color temperature over a desired range while employing only three different color components.

Figure 6:
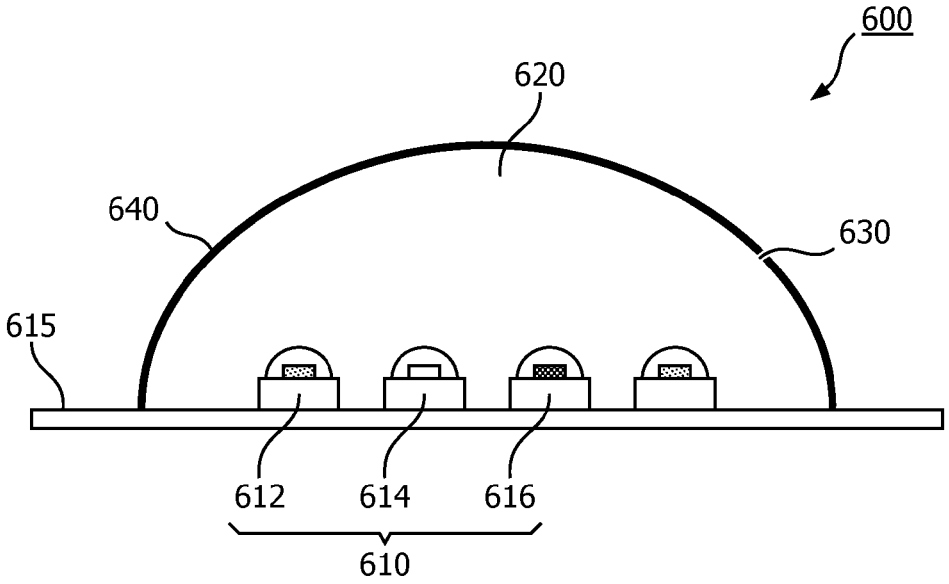
FIG. 6 illustrates an example embodiment of a tunable correlated color temperature LED-based light source.

FIG. 6 illustrates an example embodiment of a tunable correlated color temperature LED-based light source 600 which may employ the color components illustrated in FIG. 5. Light Source 600 includes a plurality of LEDs 610 mounted on a substrate or carrier 615, and a mixing chamber or cavity 620 having a light exit window 640 at which is provided a light conversion material 630.

LEDs 610 includes one or more first LEDs 612 configured to emit first light having a first color, one or more second LEDs 614 configured to emit second light having a second color, and one or more third LEDs 616 configured to emit third light having a third color. Beneficially, first LEDs 612, second LEDs 614, and third LEDs 616 are individually addressable or controllable so that the relative ratios of the first light, second light, and third light can be adjusted so as to vary the color temperature of the White light produced by LED-based light source 600.

Mixing chamber 620 mixes the first light, second light, and third light and outputs the mixed light through light exit window 640. Besides mixing chamber 620, other types of mixing devices may be employed.

Light conversion material 630 may comprise a translucent remote phosphor, or phosphorous material provided at light exit window 640 of mixing chamber 620. In some embodiments, light conversion material 630 may be provided as a coating on light exit window 640 of mixing chamber 620. In other embodiments, light conversion material 630 may be incorporated into the material forming light exit window 640 of mixing chamber 620, for example integrated into the matrix of the material. Light conversion material 630 converts the first light to Lime light.

In some embodiments, first LEDs 612 are White LEDs, second LEDs 614 are Blue or Cyan LEDs, and third LEDs 616 are Red or Red-Orange LEDs. First LEDs 612 may comprise Warm White LEDs, Neutral White LEDs, or Off-White LEDs, as defined above. In general, however, Cool-White LEDs having a color temperature>6000° K (for example, 7000° K) have a greater efficiency than Warm White LEDs, Neutral White LEDs, or Off-White LEDs. Accordingly, first LEDs 612 may instead comprise Cool-White LEDs. This can provide increased efficiency, but perhaps with some loss of tuning range at the lower color temperatures.

Light conversion layer 630 may convert the White light to Lime, and convert the Blue light to a less saturated Blue or a relatively Cool Off-White color. Light conversion material 630 may perform very little if any conversion of the Red (or Red-Orange) light of third LEDs 616. In particular, light conversion material 630 may convert a Blue component of the White light from first LEDs 612 to the Lime light with a greater efficiency than it converts the Blue light from second LEDs 614, for example because of a difference in the dominant or primary wavelengths of the Blue component of the White light from first LEDs 612 and the Blue light from second LEDs 614. For example, the White light from first LEDs 612 may have a Blue component with wavelengths at or near 440 nm where light conversion material 630 has a greater conversion efficiency, and the Blue light from second LEDs 614 may have a primary or dominant wavelength at 480 nm where light conversion material 630 has a lower conversion efficiency. Beneficially, light conversion material 630 has a moderate conversion efficiency of, for example, 40-65% for converting the White light to Lime light. In one example embodiment, the conversion efficiency may be 55%. In one embodiment the light conversion material comprises LuAG. When Cool-White LEDs are employed in place of Neutral-White, Warm-White, or Off-White LEDs, then the conversion efficiency of light conversion material 630 may be as low as 20%.

In other embodiments, first LEDs 612 are Blue LEDs emitting the first light having a first dominant or primary wavelength, second LEDs are Blue LEDs emitting the second light having a second dominant or primary wavelength, and the third LEDs are Red or Red-Orange LEDs. In particular, first LEDS 612 may emit Blue light with a primary wavelength less than 460 nm (e.g., 445 nm), second LEDs may emit Blue or Cyan light with a primary wavelength greater than 460 nm (e.g., 465 nm or 480 nm), and light-conversion material 630 may have a greater conversion efficiency at the primary wavelength of the first light emitted by first LEDs 612 than at the primary wavelength of the second light emitted by second LEDs 614.

As a result of the configuration described above, LED-based light source 600 may provide three individually addressable colors: Lime, Blue or Cool Off-White, and Red or Red-Orange, the relative levels of each of which may be adjusted to cause LED-based light source 600 to emit White light having a desired intensity and color temperature.

Beneficially, LED-based light source 600 may provide White light having a tunable color temperature over a desired range while employing only three different color LEDs, which may reduce the cost and complexity of LED-based light source 600.

Figure 7:
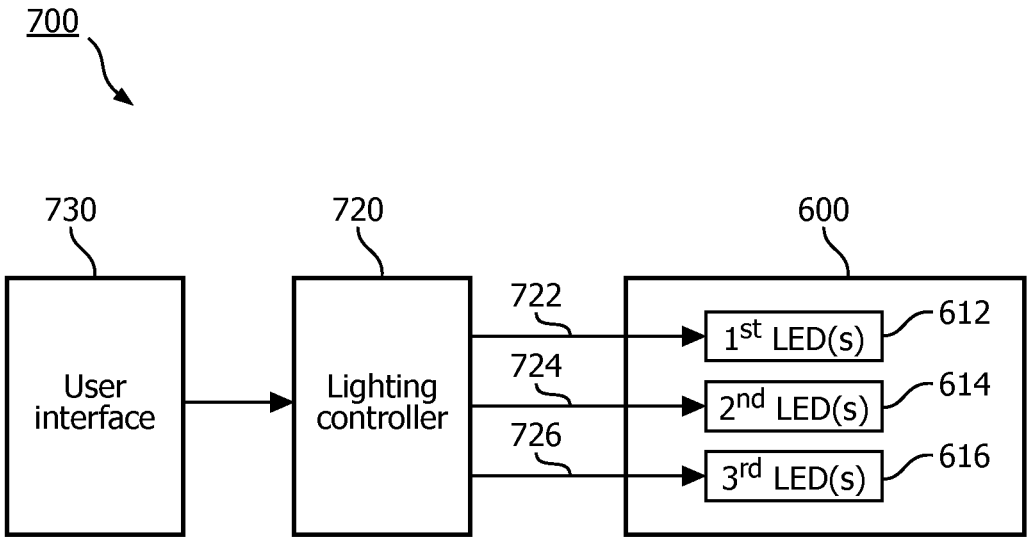
FIG. 7 is a block diagram of a lighting unit which includes an example embodiment of a tunable correlated color temperature LED-based light source.

FIG. 7 is a block diagram of a lighting unit 700. Lighting unit 700 includes tunable correlated color temperature LED-based light source 600, a lighting controller 720, and a user interface 730.

Tunable correlated color temperature LED-based light source 600 includes first LEDs 612, second LEDs 614, and third LEDs 616 as shown in FIG. 7 and described above with respect to FIG. 6, as well as mixing device 620 and light conversion material 630 which for simplicity of illustration are not shown in FIG. 7.

Lighting controller 720 supplies driving or control signals 722, 724 and 726 to first LEDs 612, second LEDs 614, and third LEDs 616, respectively so as to adjust or control an intensity and a color temperature of the light output by LED-based light source 600. In particular, lighting controller 720 may receive one or more control signals generated via user interface 730 which indicate one or more characteristics (e.g., intensity and/or color temperature) selected by a user for the light to be output by LED-based light source 600. In response thereto, lighting controller 720 determines the appropriate driving or control signals 722, 724 and 726 to be supplied to cause LED-based light source 600 to emit light having the selected characteristics.

User interface 730 may include a display screen, a touch screen, a mouse, a keyboard, a touchpad, one or more slider controls, one or more knobs, and/or other devices for allowing a user to select one or more parameters of light output by LED-based light source 600, including for example, an intensity and a color point of light output by LED-based light source 600. User interface 730 may operate in conjunction with one or more software routines stored in a memory device of lighting unit 700 and controlled by a microprocessor of lighting unit 700.

In some embodiments, LED-based light source 600 may be included in a lighting network. In those embodiments, lighting controller 720 may control one or more other lighting devices in addition to LED-based light source 600, for example using network connections between lighting controller 720 and the light sources.

Figure 8:
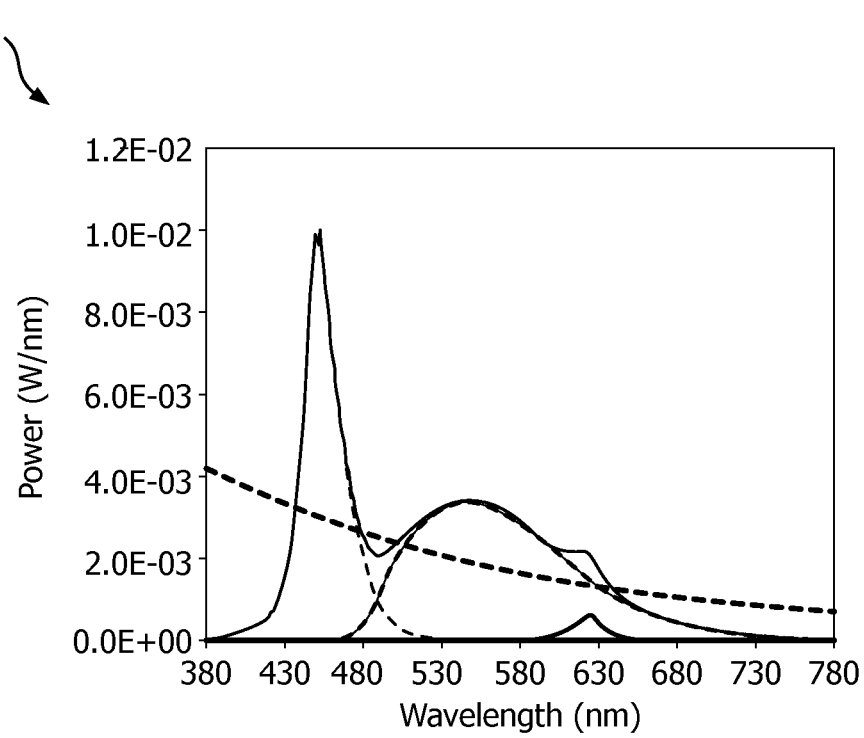
FIG. 8 illustrates an example spectrum of light which may be output by an example embodiment of a tunable correlated color temperature LED-based light source when tuned to a first color temperature.

FIG. 8 illustrates an example spectrum of light which may be output by an example embodiment of a tunable correlated color temperature LED-based light source when tuned to a first color temperature.

In particular, FIG. 8 illustrates an example spectrum which may be generated by an LED-based light source 600 consisting of three types of LEDs: a Cool-White LED (CCT~5500 K), a Blue LED, and a Red LED. In this example, the Blue LED has a primary or dominant wavelength of 450 nm, and the Cool-White LED is a phosphor-converted LED, where the LED has a primary or dominant wavelength of 450 nm and is converted by the YAG phosphor to be Cool-White light. Over these LEDs a remote phosphor component containing, e.g., LuAG phosphor is placed. FIG. 8 illustrates an example spectrum, corresponding to a CCT of 12000 K (on the black body), which may be produced by this arrangement if only the Blue LED(s) and the Red LED(s) are driven.

Figure 9:
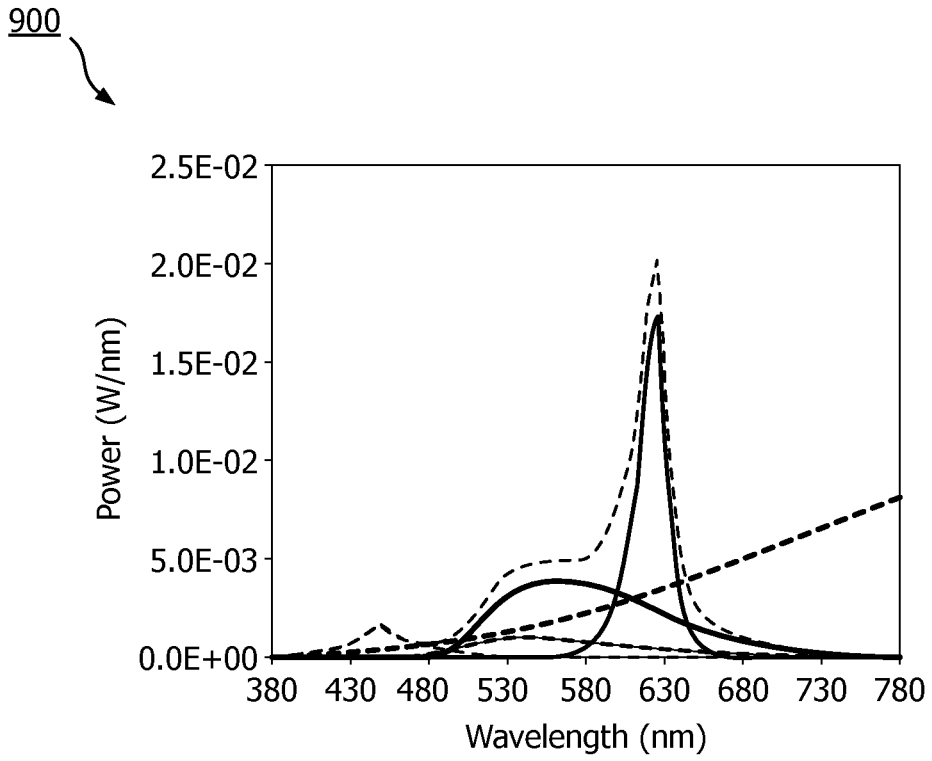
FIG. 9 illustrates an example spectrum of light which may be output by the example embodiment of a tunable correlated color temperature LED-based light source when tuned to a second color temperature.

FIG. 9 illustrates an example spectrum of light which may be output by the a tunable correlated color temperature LED-based light source having the above-described configuration when tuned to a second color temperature of 2200 K (on the black body), which may be produced by this arrangement if only the Cool-White LED(s) and the Red LED(s) are driven.

Figure 10:
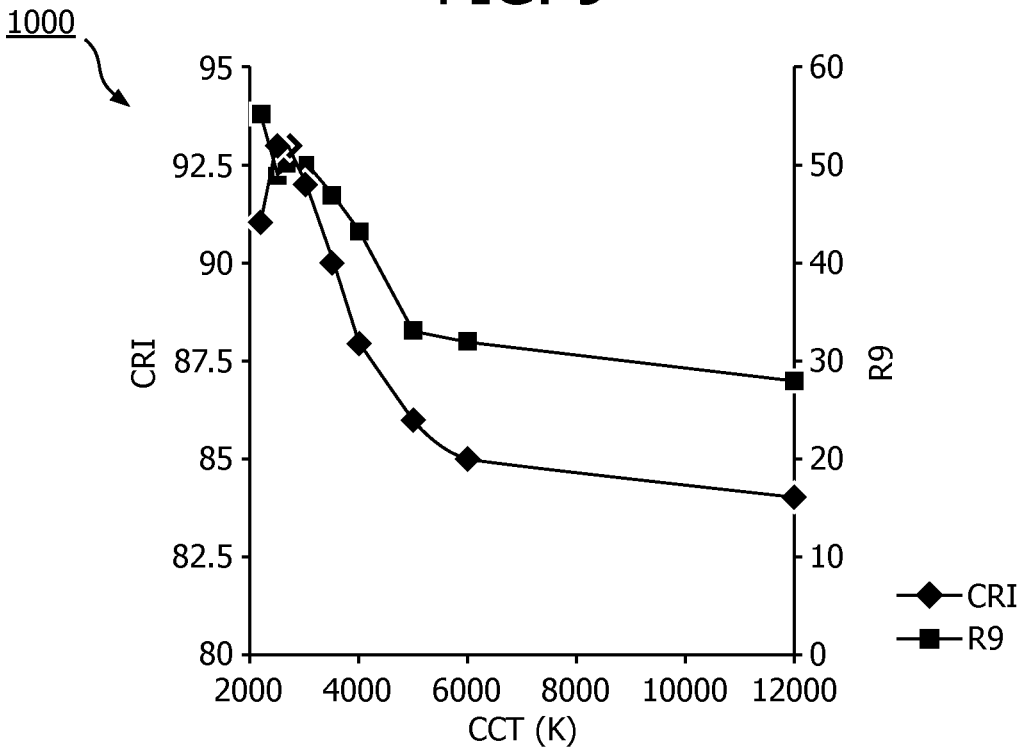
FIG. 10 illustrates a color rendering index (CRI) and Red color rendering index R9 as a function of correlated color temperature for an example embodiment of a tunable correlated color temperature LED-based light source.
Figure 11:
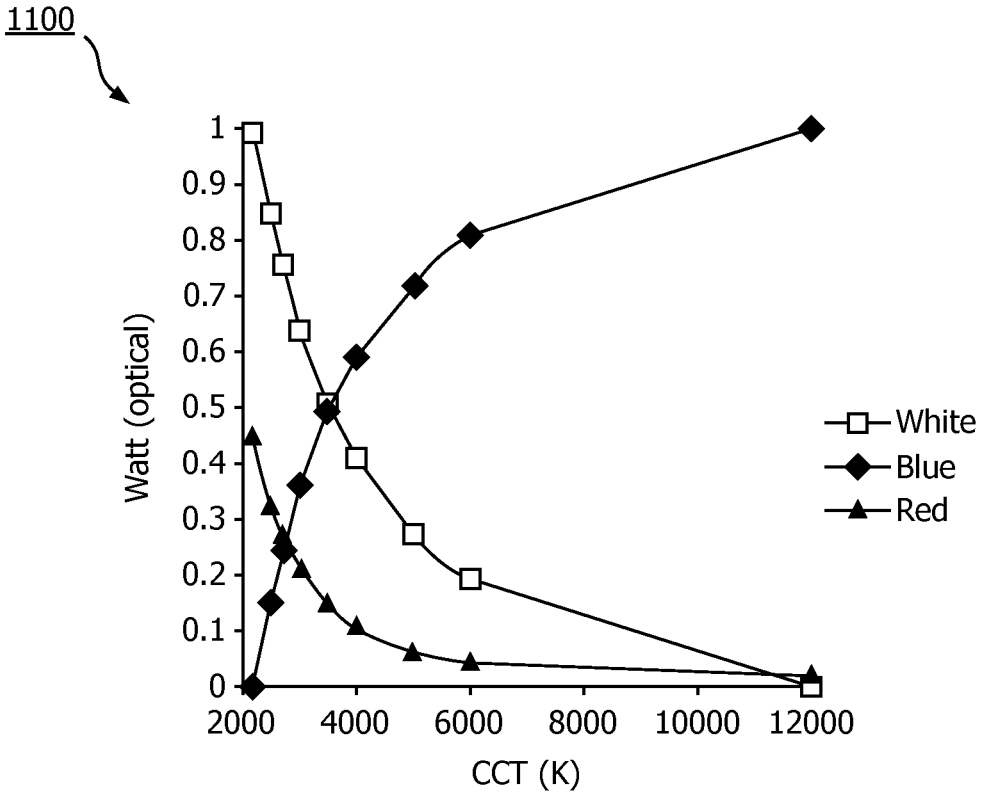
FIG. 11 illustrates the relative contributions of the different colored LEDs as a function of correlated color temperature in an example embodiment of a tunable correlated color temperature LED-based light source.

FIGS. 10 and 11 illustrate that all correlated color temperatures (CCTs) in between 2200 K and 12000 K may be produced by the example embodiment having the above-described configuration. FIG. 10 illustrates color rendering index (CRI) and Red color rendering index R9 as a function of CCT, and FIG. 11 illustrates the relative contributions of the different colored LEDs as a function of CCT.

Figure 12:
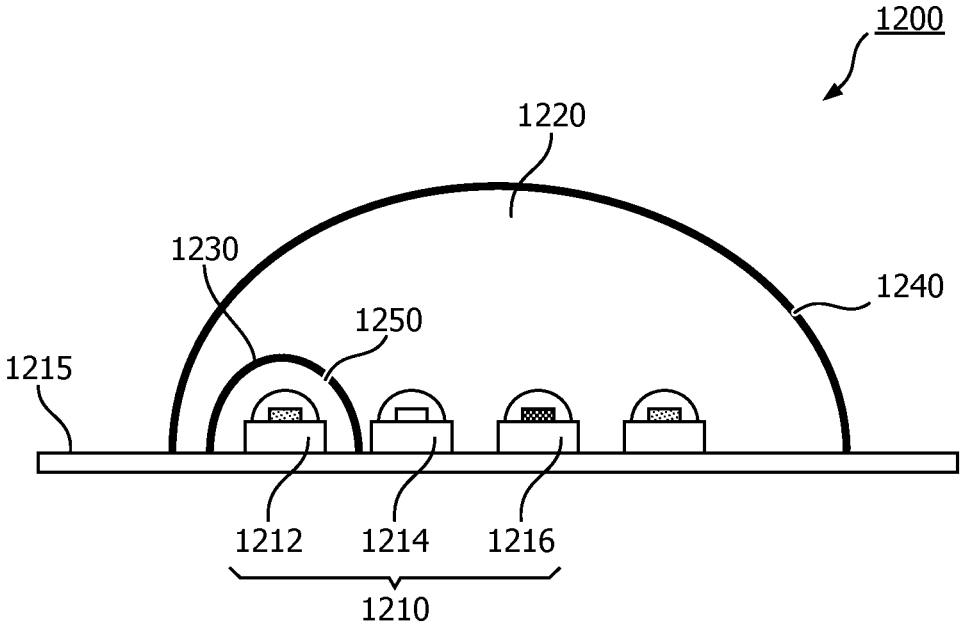

FIG. 12 illustrates another example embodiment of a tunable correlated color temperature LED-based light source 1200. Light Source 1200 includes a plurality of LEDs 1210 mounted on a substrate or carrier 1215, a mixing chamber or cavity 1220 having a light exit window 1240, and a cover element 1250 at which is provided a light conversion material 1230, which, for example, can be coated on cover element 1250, or incorporated into the material forming cover element 1250.

LEDs 1210 includes one or more first LEDs 1212 configured to emit first light having a first color, one or more second LEDs 1214 configured to emit second light having a second color, and one or more third LEDs 1216 configured to emit third light having a third color. Beneficially, first LEDs 1212, second LEDs 1214, and third LEDs 1216 are individually addressable or controllable so that the relative ratios of the first light, second light, and third light can be adjusted so as to vary the color temperature of the White light produced by LED-based light source 1200. Beneficially, first LEDs 1212 and third LEDs 1216 may be the same color LEDs, for example Blue LEDs, and the first color may be the same as the third color. Second LEDs 1214 may be Red or Red-Orange LEDs.

Cover 1250 is disposed only over first LEDs 1212 such that light conversion material 1230 converts only the first light from first LEDs 1214 to Lime light. Light conversion material 1230 may comprise a translucent remote phosphor, or phosphorous material, coated onto the cover element 1250.

Mixing chamber 1220 is configured to receive the converted first light having the Lime color output from cover 1250, to receive the second light from second LEDs 1214, and to receive the third light from third LEDs 1216, to mix the first light, second light, and third light, and to output a mixed light from exit window 1240. Besides mixing chamber 1220, other types of mixing devices may be employed.

As a result of the configuration described above, LED-based light source 1200 may provide three individually addressable colors: Lime, Blue and Red or Red-Orange, the relative levels of each of which may be adjusted to cause LED-based light source 1200 to emit White light having a desired intensity and color temperature.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

Also, reference numerals appearing in the claims in parentheses, if any, are provided merely for convenience and should not be construed as limiting the claims in any way.

The invention claimed is:

1. A lighting unit including an LED-based light source, the LED-based light source comprising:

a plurality of light-emitting diodes (LEDs), including at least one white LED, at least one blue LED and at least one red or red or red-orange LED; with a difference in the dominant or primary wavelengths of a blue component of the white light from the first LED and the blue light from the second LED;

a mixing device configured to mix light output by the plurality of LEDs, wherein the mixing device includes an exit window configured such that the mixed light is emitted from the mixing device through the exit window;

a light-conversion material provided at the exit window, wherein the light-conversion material is configured to convert light emitted from the at least one white LED to have a lime color;

a lighting controller configured to adjust a correlated color temperature of the LED-based light source by adjusting relative current levels provided to the at least one white LED, the at least one blue LED, and the at least one red LED.

2. The lighting unit of claim 1, wherein the light-conversion material is configured to convert light from the at least one blue LED to be cool white light.

3. The lighting unit of claim 1, wherein the light-conversion material comprises a LuAG phosphor.

4. The lighting unit of claim 1, wherein the lime color has a peak output at a wavelength of between 550-580 nm.

5. The lighting unit of claim 1, wherein the lime color lies within an area of the CIE 1931 color space chromaticity diagram bounded by the coordinates: 0.456, 0.524; 0.354, 0.605; 0.308, 0.494; and 0.413, 0.451.

6. The lighting unit of claim 4, wherein the lime color lies within an area of the CIE 1931 color space chromaticity diagram bounded by the coordinates: 0357, 0490; 0.395, 0.474; 0.425, 0.528; and 0.393, 0.564.

7. The lighting unit of claim 1, wherein the light emitted from the at least one white LED is neutral white light.

8. The lighting unit of claim 1, wherein the light emitted from the at least one white LED is warm white light.

9. The lighting unit of claim 1, wherein the light emitted from the at least one white LED is off-white light.

10. The lighting unit of claim 1, wherein the light-conversion material converts the light emitted from the at least one white LED to a lime color with a conversion efficiency of between 40-55%.

11. The lighting unit of claim 10, further comprising a user interface connected to the lighting controller, configured to provide one or more signals to the lighting controller for selecting the correlated color temperature of the LED-based light source.

12. A light source, comprising:

a plurality of LEDs, including one or more first LEDs configured to emit first light having a first color, one or more second LEDs configured to emit second light having a second color, and one or more third LEDs configured to emit third light having a third color;

a mixing device configured to mix the first light, the second light, and the third light into a mixed light, wherein the mixing device includes an exit window configured such that the mixed light is emitted from the mixing device through the exit window; and a light-conversion material provided at the exit window, wherein the light-conversion material is configured to convert the first light from the first color to a lime color;

a lighting controller to adjust or control an intensity and a color temperature of the light output by the light source;

wherein the first light is a blue light with a primary wavelength less than 460 nm, wherein the second light is a blue or cyan light with a primary wavelength greater than 460 nm, and wherein a conversion efficiency of the light-conversion material is greater at the primary wavelength of the first light than at the primary wavelength of the second light.

13. The light source of claim 12, wherein the first color is white, the second color is blue, and the third color is red or red-orange.

14. The light source of claim 12, wherein the lime color lies within an area of the CIE 1931 color space chromaticity diagram bounded by the coordinates: 0456, 0524; 0.354, 0.605; 0.308, 0.494; and 0.413, 0.451.

15. The light source of claim 12, wherein the light-conversion material comprises a LuAG phosphor.

16. A light source, comprising:

a plurality of LEDs, including at least a first group of one or more first LEDs configured to emit first light having a first color, at least a second group of one or more second LEDs configured to emit second light having a second color, and at least a third group of one or more third LEDs configured to emit third light having a third color;

a cover disposed in a light emission path of the first group of LEDs;

a light-conversion material provided at the cover, wherein the light-conversion material is configured to convert the first light from the first color to a lime color; and a mixing device having an exit window, wherein the mixing device is configured to receive the converted first light output from the cover, to receive the second light, and to receive the third light, and to mix the first light, second light, and third light and to output a mixed light from the exit window;

wherein the first color is blue, the second color is blue or a cool white, and the third color is red or red-orange.

17. The light source of claim 16, wherein the light-conversion material comprises a LuAG phosphor.

* * * * *